US009849937B1

(12) United States Patent
Overbey

(10) Patent No.: US 9,849,937 B1
(45) Date of Patent: Dec. 26, 2017

(54) BOATING SAFETY DEVICE

(71) Applicant: Timothy B. Overbey, St. Peterburg, FL (US)

(72) Inventor: Timothy B. Overbey, St. Peterburg, FL (US)

( * ) Notice: Subject to any disclaimer, the term of this patent is extended or adjusted under 35 U.S.C. 154(b) by 0 days.

(21) Appl. No.: 15/246,596

(22) Filed: Aug. 25, 2016

(51) Int. Cl.
*B63B 13/00* (2006.01)
*B63B 13/02* (2006.01)

(52) U.S. Cl.
CPC ..... *B63B 13/02* (2013.01)

(58) Field of Classification Search
CPC ..... B63B 13/00; B63B 2013/005; B63B 2705/00; B63B 2707/00; B63B 13/02; B63B 2013/02
USPC ..... 114/197, 198
See application file for complete search history.

(56) References Cited

U.S. PATENT DOCUMENTS 4,520,950 A * 6/1985 Jeans ..... B67D 1/0021 137/212
4,555,371 A * 11/1985 Jeans ..... B67D 1/0021 141/29
5,336,325 A * 8/1994 Devilbiss ..... F27B 17/0025 118/719
6,928,943 B1 * 8/2005 Neubauer ..... B63B 13/00 114/197
6,973,891 B1 * 12/2005 Warner ..... B63B 13/00 114/197
2006/0260525 A1 * 11/2006 DeHart ..... B63B 13/00 114/197
2008/0190351 A1 * 8/2008 Beers ..... B63B 13/00 114/382
2011/0126394 A1 * 6/2011 Heimmer ..... B25B 27/023 29/426.2
2011/0259255 A1 * 10/2011 Pitts ..... B63B 13/00 114/197

* cited by examiner

*Primary Examiner* — Daniel V Venne
(74) *Attorney, Agent, or Firm* — Larson & Larson, P.A.; Frank Liebenow

(57) ABSTRACT

A boat safety device includes a base portion that has a boat plug retaining cavity. The boat plug retaining cavity is sized for accepting and holding a boat drain plug and is optionally threaded to match threads of the boat drain plug. A key hole goes through a wall of the base portion and is sized to accept a boat key. The key hole is interfaced with the boat plug retaining cavity such that when a key is inserted fully into the key hole, teeth of the key extend into the boat plug retaining cavity so that, after installing the boat drain plug into the boat plug retaining cavity, the key is held in the key hole until the boat drain plug is later removed from the boat plug retaining cavity. Optionally, a key guard is provided to reduce chances of bending the boat key.

16 Claims, 2 Drawing Sheets

BOATING SAFETY DEVICE

FIELD

This invention relates to the field of boating and more particularly to a device for reducing the chances of a pleasure craft sinking.

BACKGROUND

Countless people from around the world take pleasure in boating every day. Many take excursions or go fishing on various sizes and types of boats, of particular interest are those who utilize powerboats.

A powerboat is any boat that is driven by a motor, such as an electric motor, gasoline motor, or a diesel motor. Often, powerboats are removed from the water after they are used, either placed upon a trailer, lifted into a high-and-dry, of lifted out of the water on a personal boat lift.

As such powerboats are subject to intrusion by water, either water washing over the gunnel of the boat, rain, etc., such water builds up in the hull of the boat. The presence of such water causes several issues, including increased corrosion and excess weight. The excess weight is a particular problem as it is possible that the weight limits of a boat lift are exceeded when the boat accumulates significant amounts of water.

To reduce issues related to water buildup in the hull, many boats have a drain plug, typically at the transom end of the hull. The drain plug is removable from the outside of the transom, so that after placing the boat on a trailer or lifting the boat out of the water. The drain plug is removed and most water in the hull drains from the drain. Additionally, for boats left outside as is often the case for boats on lifts, rain water continues to drain until the drain plug is replaced.

Unfortunately, many boaters have experienced what happens when they forget to replace the drain plug before placing the boat back in the water. Instead of water draining from the drain, water enters the hull through the drain. Hopefully, the boater realizes what is happening before the boat sinks, but unfortunately, in some boats, once the water rises to a certain level, the engine stops, making for serious problems. One popular boating web site asked, "Have you ever forgotten to install the drain plug?" to members and, out of 130 respondents, almost 43 percent admitted to forgetting the drain plug.

What is needed is an apparatus that will help a boater remember to install the boat plug.

SUMMARY

In one embodiment, a boat safety device is disclosed including a base portion that has a boat plug retaining cavity. The boat plug retaining cavity is sized for accepting and holding a boat drain plug and, in some embodiments, the boat plug retaining cavity is threaded to match threads of the boat drain plug. A key hole goes through a wall of the base portion and is sized to accept a boat key. The key hole is interfaced with the boat plug retaining cavity such that when a key is inserted fully into the key hole, teeth of the key extend into the boat plug retaining cavity.

In another embodiment, a method of reminding one to install a boat drain plug before starting the boat is disclosed including removing the boat drain plug, then placing a boat key in a key hole of a boat safety device, and then threading the boat drain plug into the boat safety device, thereby holding the boat key firmly within the boat safety device. Later, to get underway, unthreading the boat drain plug from the boat safety device, replacing the boat drain plug 3, then removing the boat key from the boat safety device.

In another embodiment, a boat safety apparatus is disclosed including a base portion having a key hole for accepting a boat key and a boat plug retaining cavity for accepting and holding a boat drain plug. In such, when a boat key is inserted into the key hole, the boat key is held securely in place after the boat drain plug is inserted fully into the boat plug retaining cavity.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
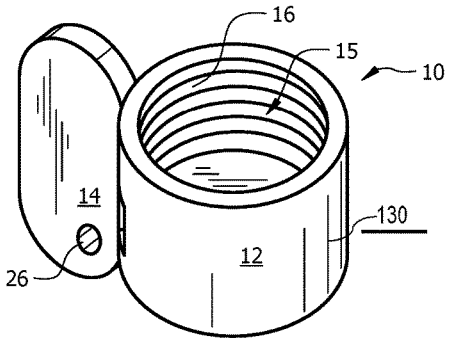
FIG. 1 illustrates a perspective view of a boat safety device.

Reference will now be made in detail to the presently preferred embodiments of the invention, examples of which are illustrated in the accompanying drawings. Throughout the following detailed description, the same reference numerals refer to the same elements in all figures.

Figure 2:
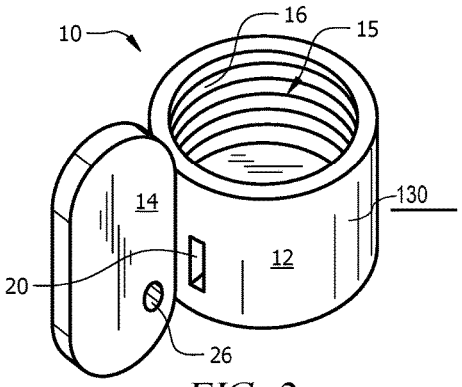
FIG. 2 illustrates a second perspective view of the boat safety device.

Referring to FIGS. 1 and 2, perspective views of a boat safety device 10 are shown. The boat safety device 10 includes a base portion 12 that has a boat plug retaining cavity 15 for receiving a boat drain plug 30 (see FIGS. 3-5). In the embodiments shown, the boat plug retaining cavity 15 has threads 16 on an inside surface of a wall 130 of the boat plug retaining cavity 15 that match the threads 32 (see FIGS. 3 and 5) of the boat drain plug 30. The boat plug retaining cavity 15 is for accepting and holding a boat drain plug 30. The base portion 12 also has a key hole 20 passing through the wall 130 that is sized to receive a boat key 40 (see FIGS. 3-5). The key hole 20 is for accepting a boat key 40 (see FIG. 5).

In some embodiments, a key guard 14 extends from or is attached to the base portion 12. The key guard 14 is for guarding the boat key 40 from bending. When present, the key guard 14 provides protection from torque when the boat drain plug 30 is threaded into the boat plug retaining cavity 15, as without the key guard 14, a user would hold the boat key 40 while tightening the boat drain plug 30 into the boat plug retaining cavity 15. In embodiments having the key guard 14, it is anticipated that the key guard 14 include a key chain hole 26 for connecting the boat safety device 10 to, for example, a key chain or key ring.

Figure 3:
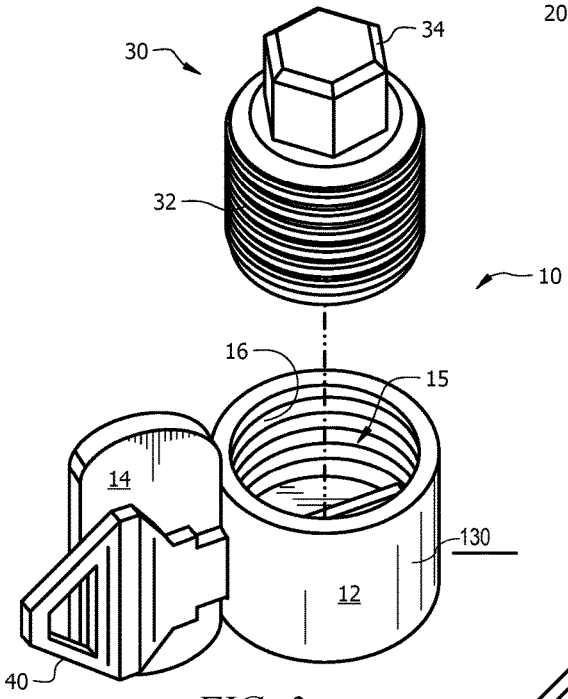
FIG. 3 illustrates a perspective view of the boat safety device ready to accept a boat drain plug.
Figure 4:
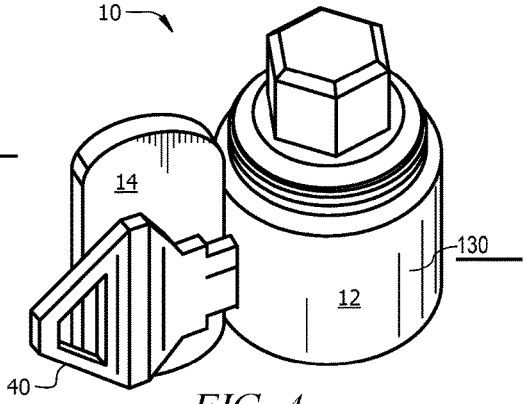
FIG. 4 illustrates a perspective view of the boat safety device holding a boat drain plug.

Referring to FIGS. 3 and 4, perspective views of the boat safety device 10 are shown. In FIG. 3, the boat safety device 10 holds a boat key 40 and is ready to accept a boat drain plug 30.

The boat drain plug 30 is shown ready to enter the boat plug retaining cavity 15 which is hollow. The boat drain plug 30 typically has a driver end 34 (in this example a hex-head, though the boat drain plug 30 is not limited in any way). The driver end 34 is used to remove the boat drain plug 30 from the boat drain (not shown), should the boat drain plug 30 be too tight.

The threads 32 and diameter of the boat drain plug 30 are similar to the diameter and threads 16 of the boat plug retaining cavity 15 such that, the boat drain plug 30 threads into the boat plug retaining cavity 15. Likewise, the key hole 20 is sized such that the boat key 40 fits within the key hole 20. When the boat key 40 is inserted into the key hole 20, teeth 41 of the key extend into the boat plug retaining cavity 15 so that, after installing the boat drain plug 30 into the boat plug retaining cavity 15, the boat key 40 is held in the key hole 20 by the teeth 41 not being able to exit the key hole 20 until the boat drain plug 30 is later removed from the boat plug retaining cavity 15. In doing so, the boat key 40 is held within the boat safety device 10 until the boat drain plug 30 is removed, thereby preventing the boat from operating until the boat drain plug 30 is removed from the boat safety device 10. Therefore, the boater must take positive action to be able to start the boat and the boater will be more apt to remember to install the boat drain plug 30 into the boat drain before starting the boat.

In some embodiments, the key hole 20 is cut to have a narrow, pointed edge so that the edge tangles in the teeth 41 of the key to better hold the key 41 there within.

In FIG. 4, the boat safety device 10 has accepted the boat drain plug 30 which secures the boat key 40. The boat key 40 is held securely within the key hole 20 making it difficult to start the boat until the boat drain plug 30 is removed from the boat safety device 10 and, hopefully, installed in the boat drain.

Figure 5:
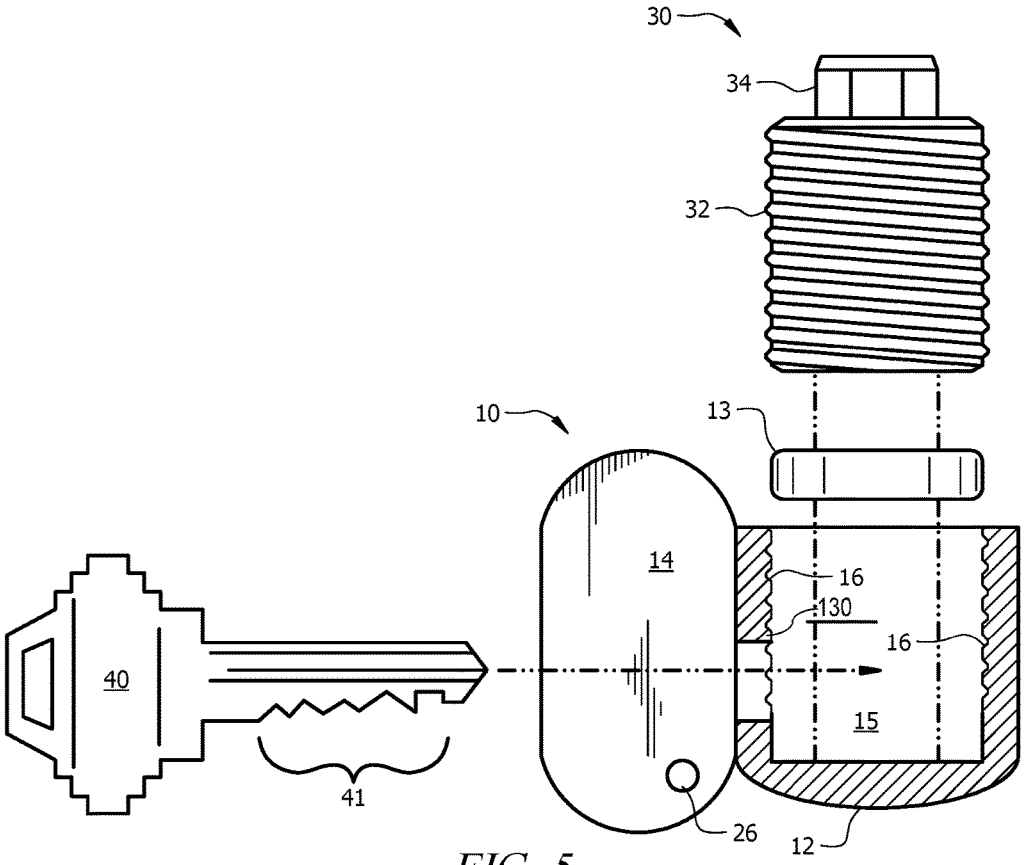
FIG. 5 illustrates a cutaway view of the boat safety device ready to accept a boat key and boat drain plug.

Referring to FIG. 5, a cutaway view of a boat safety device 10 is shown ready to accept the boat key 40 and the boat drain plug 30. The boat safety device 10 includes a base portion 12 that has a boat plug retaining cavity 15 for receiving a boat drain plug 30. In the embodiments shown, the boat plug retaining cavity 15 has threads 16 that match the threads 32 of the boat drain plug 30. The base portion 12 also has a key hole 20 sized to receive a boat key 40.

In some embodiments, a key guard 14 extends from or is attached to the base portion 12. When present, the key guard 14 provides protection from torque when the boat drain plug 30 is threaded into the boat plug retaining cavity 15, as without the key guard 14, a user would hold the boat key 40 while tightening the boat drain plug 30 into the boat plug retaining cavity 15, possibly bending the boat key 40. In embodiments having the key guard 14, it is anticipated that the key guard 14 include a key chain hole 26 for connecting the boat safety device 10 to, for example, a key chain or key ring.

In some embodiments, to further protect the boat key 40 from damage, a cushion 13 is inserted within the boat plug retaining cavity 15 such that, the teeth 41 of the boat key 40 rest against the cushion 13 when the boat drain plug is inserted into the boat plug retaining cavity 15. The cushion 13, when present, is for cushioning the boat key 40.

Although is anticipated that the boat protection device be made of any suitable material, examples of such materials include, but is not limited to, plastic, polyvinyl chloride, metal, aluminum, stainless steel, etc. In embodiments having the cushion 13, it is anticipated that the cushion 13 be made of a softer material such as rubber.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A boat safety device comprising:

a base portion;

a boat plug retaining cavity in the base portion, the boat plug retaining cavity sized for accepting and holding a boat drain plug; and a key hole in a wall of the base portion, the key hole sized to accept a boat key, the key hole is interfaced with the boat plug retaining cavity such that when a key is inserted fully into the key hole, teeth of the boat key extend into the boat plug retaining cavity.

2. The boat safety device of claim 1, further comprising a key guard extending from the base portion next to the key hole.

3. The boat safety device of claim 1, wherein the key guard includes a hole for inserting a key chain.

4. The boat safety device of claim 1, wherein the boat plug retaining cavity has threads that match threads of the boat drain plug.

5. The boat safety device of claim 1, wherein the base portion is made of plastic.

6. The boat safety device of claim 1, further comprising a cushion within the boat plug retaining cavity, such that when the boat key is inserted into the key hole, the teeth of the boat key rest upon the cushion.

7. The boat safety device of claim 6, wherein the cushion is made of rubber.

8. A method of holding a boat drain plug, the method comprising:

removing the boat drain plug;

placing a boat key in a key hole of a boat safety device, the boat key therefore passing through a wall of the boat safety device;

threading the boat drain plug into the boat safety device, thereby holding the boat key firmly within the boat safety device.

9. The method of claim 8, further comprising the steps of:

before getting underway, unthreading the boat drain plug from the boat safety device;

replacing the boat drain plug; and removing the boat key from the boat safety device.

10. A boat safety device comprising:

a base portion;

a key hole, the key hole passing through a wall of the base portion; and a boat plug retaining cavity in the base portion;

whereas a boat key inserted into the key hole is held securely in place when a boat drain plug is inserted fully into the boat plug retaining cavity.

11. The boat safety device of claim 10, further comprising a key guard for guarding the boat key from bending.

12. The boat safety device of claim 11, wherein the key guard includes a hole for inserting a key chain.

13. The boat safety device of claim 10, wherein the boat plug retaining cavity has threads that match threads of the boat drain plug.

14. The boat safety device of claim 10, further comprising a cushion for cushioning the boat key within the boat plug retaining cavity, such that when the boat key is inserted into the key hole, teeth of the boat key rest upon the cushion.

15. The boat safety device of claim 10, wherein the boat plug retaining cavity is a hollow opening.

16. The boat safety device of claim 15, wherein the hollow opening is threaded.

* * * * *